US005988142A

United States Patent [19]

Klopfer

[11] Patent Number: 5,988,142

[45] Date of Patent: Nov. 23, 1999

[54] DURATION CONTROL OF COMMON RAIL FUEL INJECTOR

[75] Inventor: Kenneth H. Klopfer, East Hartland, Conn.

[73] Assignee: Stanadyne Automotive Corp., Windsor, Conn.

[21] Appl. No.: 08/995,484

[22] Filed: Dec. 22, 1997

[51] Int. Cl.[6] ..... F02M 37/04; F02M 51/00

[52] U.S. Cl. ..... 123/446; 123/494; 73/119 A

[58] Field of Search ..... 123/446, 494; 73/119 A, 117.3

[56] References Cited

U.S. PATENT DOCUMENTS

| | | | |
|---|---|---|---|
| 4,130,013 | 12/1978 | Bailey et al. | 73/119 A |
| 4,179,939 | 12/1979 | Price | 73/119 A |
| 4,404,944 | 9/1983 | Yamazaki et al. . | |
| 4,438,496 | 3/1984 | Ohie . | |
| 4,475,507 | 10/1984 | Miyaki et al. . | |
| 4,502,438 | 3/1985 | Yasuuhara | 123/494 |
| 4,572,122 | 2/1986 | Kamai et al. | 123/494 |
| 4,887,569 | 12/1989 | Igashira et al. | 123/494 |
| 4,893,750 | 1/1990 | Haworth et al. | 123/494 |
| 5,103,792 | 4/1992 | Winkler et al. . | |
| 5,485,822 | 1/1996 | Hirose et al. . | |
| 5,697,338 | 12/1997 | Hirose et al. . | |

*Primary Examiner*—Thomas N. Moulis
*Attorney, Agent, or Firm*—Alix, Yale & Ristas, LLP

[57] ABSTRACT

A fuel injector employs at least one sensing device for sensing material deformations occurring in the injector components during usage to thereby monitor injector performance. The sensing device is preferably at least one of the many piezoelectric sensors available and is advantageously affixed within a cylinder of an injector to detect deformations of the injector cylinder within the needle valve/power piston column of an injector to detect deformations of the column which occurs when the high-pressure fuel in the control chamber is suddenly converted pressure and vice versa. Whereas the sensing devices of the invention can be placed at a variety of locations, they are advantageously arranged to detect material deformations within the injector cylinder or valve/piston column where such deformations are appreciably large during injector usage. Preferably, injectors of the invention are compatible with microprocessor-based fuel injection control systems of the type described above to maintain near-ideal control over the injector.

27 Claims, 9 Drawing Sheets

DURATION CONTROL OF COMMON RAIL FUEL INJECTOR

BACKGROUND OF THE INVENTION

1. Field of the Invention

The present invention generally relates to fuel injection systems for internal combustion engines. More particularly, the invention relates to an improved fuel injector for supplying fuel to an internal combustion engine and methods of controlling the improved fuel injection nozzle. Accordingly, the general objects of the present invention are to provide novel and improved methods and apparatus of such character.

2. Description of the Related Art

Fuel injection nozzles for supplying fuel to internal combustion engines are well known in the art. Such injectors typically employ an injector body which is affixed to an internal combustion engine such that a nozzle end thereof extends into an engine cylinder. The injector body defines an interior cavity which is fluidly connected with a fuel supply and includes a needle valve which cooperates with the injector body to selectively permit fluid received from the fuel supply to pass through the interior cavity of the injector body and into the engine cylinder. Since most internal combustion engines employ a plurality of cylinders, it is common to employ one or more of such injectors with each engine. Recent developments have focused on supplying fuel to these multiple injectors from a common fuel supply rail which is maintained at very high-pressure, e.g., typically between 2900 to 26100 psi or 200 to 1800 bar.

One of this type of common rail injector is shown in FIG. 1, during the non-injection phase of the injection cycle. The injector 10 of FIG. 1 employs a hydraulic force imbalance scheme wherein a power piston 12 disposed at one end of a needle valve 14 cooperates with other components to control the net system forces acting upon the needle valve 14. In the design shown, a control chamber 16 which lies adjacent one end of the power piston 12 contains a volume of high-pressure fuel during the non-injection phase of the injection cycle. The force of this high-pressure fuel acts downwardly on the power piston 12 to overcome the opposed upward force of the high-pressure fuel acting on annular surface 17 and to thereby urge an opposite end 20 of the needle valve 14 into sealing engagement with apertured nozzle 21 of an injector body 24. In this phase of injection operation, the fuel supplied to injector 10 via inlet 11, is not permitted to pass into the engine cylinder. However, for the injection phase, the pressure within the control chamber 16 can be relieved by energizing a solenoid actuator 33 to move a valve 26 and open a spill path 28 from the control chamber 16 to low-pressure fuel region 52 thereby decreasing the pressure in the control chamber 16. When the pressure within the control chamber 16 drops to a predetermined level, based on the geometry of various injector components, the needle valve 14 moves upwardly to permit fuel to flow through the apertured nozzle 21 of the injector body 24 and into the engine cylinder. De-energizing the solenoid actuator 33 closes the fuel spill path 28. The pressure within the control chamber 16 then increases until it overcomes the upward force acting on the surface 17 and the needle valve 14 is again urged into its initial position. With the fuel injection cycle thus completed, it can be repeated as desired.

Fuel injectors of the type discussed above suffer from a number of deficiencies which tend to limit overall performance. Injector performance can deviate from the ideal due to a wide variety of performance variables and conditions.

For example, limitations on manufacturing tolerances can result in the production of injectors which deviate from nominal design specifications. Moreover, changes in fuel viscosity can have a substantial impact on injector performance even in perfectly manufactured injectors. A difference in fuel viscosity can, for example, result from the use of different fuel types and grades. Additionally, ambient environmental conditions such as temperature can cause further fuel viscosity variations. Another factor impacting injector performance characteristics is physical wear and deterioration of injector components occurring over the field-life of the injector. Finally, changes in the electrical characteristics of the actuators employed with such injectors can result in still further deviations from ideal performance. These and other factors all contribute to injector performance characteristics which can deviate measurably from those originally intended.

In order to detect and compensate for such deviations, microprocessor-based fuel injector control systems and microprocessor-based diagnostic systems have been developed. Such control systems more precisely regulate the fuel injection timing and/or quantity by improving the electrical control of electrical actuators used with such injectors. One example of such a control system is described in U.S. Pat. No. 5,103,792 dated Apr. 14, 1992 and entitled "Processor Based Fuel Injection Control System", the contents of which are hereby incorporated by reference.

Several examples of sensing devices for use with such control systems and microprocessor-based diagnostic systems are discussed in U.S. Pat. No. 4,775,516, dated Oct. 4, 1988, the contents of which are also hereby incorporated by reference. The systems discussed therein all utilize piezoelectric sensors to detect fluid flow through fuel conduits at locations remote from fuel injectors connected thereto. As a result, these systems are subject to severe limitations as to sensor and/or control system accuracy, versatility, reliability, sensitivity and/or economy.

Other microprocessor based systems utilize sensors which monitor the electrical signal delivered to, or the movement of, an injector actuating solenoid. Such sensors may include a solenoid position sensing coil formed as a part of the solenoid or means to detect the back electromotive force coming from an actuated solenoid. Since movement of the needle valve in such a fuel injector is so remote from the solenoid, however, solenoid-type sensors suffer from many, if not all, of the deficiencies noted above with respect to previous piezoelectric schemes. Therefore, while the injection diagnosis and control methods and devices such as those described in U.S. Pat. Nos. 5,103,792 and 4,775,816 have resulted in marked improvements in injector performance, further improvements are still possible. In particular, further improvements in the art are possible because the more directly and rapidly a dedicated sensor can detect the moment at which actual fuel injection into an engine begins (BOI) and/or ends (EOI), the more precisely the control system can regulate fuel injection timing and quantity.

SUMMARY OF THE INVENTION

Accordingly, it is an object of the present invention to provide an injector having a dedicated and improved sensing device to more directly detect the duration of fuel injection events occurring during the injection cycle of the injector.

It is a further object of the present invention to provide an improved fuel injector including a dedicated BOI and EOI detection sensor for use in a microprocessor-based fuel injection control system wherein the signals generated by the sensor more accurately reflect the timing and duration of the injection events of the injector.

It is still another object of the present invention to provide an improved fuel injector which utilizes a novel injection duration sensing scheme with a fuel injection control system to achieve an optimal combination of injector (1) simplicity; (2) reliability; (3) efficiency; and (4) fuel injection accuracy.

These and other objects and advantages of the present invention are provided in one embodiment by providing a fuel injector of the general nature discussed above which employs at least one sensing device for sensing material deformations occurring in the injector components during usage to thereby monitor injector performance. Since changes in the physical properties of the fuel flowing through the injector cause material deformations within the injector, detecting such material deformations allows the present invention to determine the duration of the injection phase of the injection cycle. Thus, the electrical signals generated by the sensing device are directly related to the duration of fuel flow through the injector. The sensing device is preferably at least one of the many piezoelectric sensors available and is advantageously affixed within a cylinder of an injector to detect deformations of the injector which occurs when high-pressure fuel in the injector is suddenly converted to low pressure and vice versa. Whereas the sensing devices of the instant invention can be placed at a variety of locations, they are advantageously arranged to detect material deformations within the injector cylinder where such deformations are appreciably large during injector usage. Preferably, injectors of the instant invention are compatible with microprocessor-based fuel injection control systems of the type described above to maintain near-ideal control over the injector.

An alternative location for a piezoelectric or other strain sensing device is in the needle valve/power piston column. In this case the strain sensing device is used to detect deformations of the needle valve/power piston column which occur when high-pressure fuel in the injector is suddenly converted to low pressure and vice versa.

Numerous other advantages and features of the present invention will become apparent to those of ordinary skill in the art from the following detailed description of the invention, from the claims and from the accompanying drawings.

BRIEF DESCRIPTION OF THE DRAWINGS

The preferred embodiments of the present invention will be described below with reference to the accompanying drawings wherein like numerals represent like structures and wherein.

DESCRIPTION OF THE PREFERRED EMBODIMENTS

A first preferred embodiment of the injector according to the invention will be described primarily with joint reference to FIGS. 2*a* through 3*b*. Those of ordinary skill in the art will readily appreciate that FIGS. 3*a* through 6 show the present invention incorporated into an electrically controlled common-rail type fuel injector for use with a diesel engine such as the injector of FIGS. 2*a* and 2*b*. However, it will also be appreciated that the instant invention can be incorporated into a variety of other styles of fuel injectors which are controlled by rapid fluid flow changes induced as part of the control event.

Figure 1:
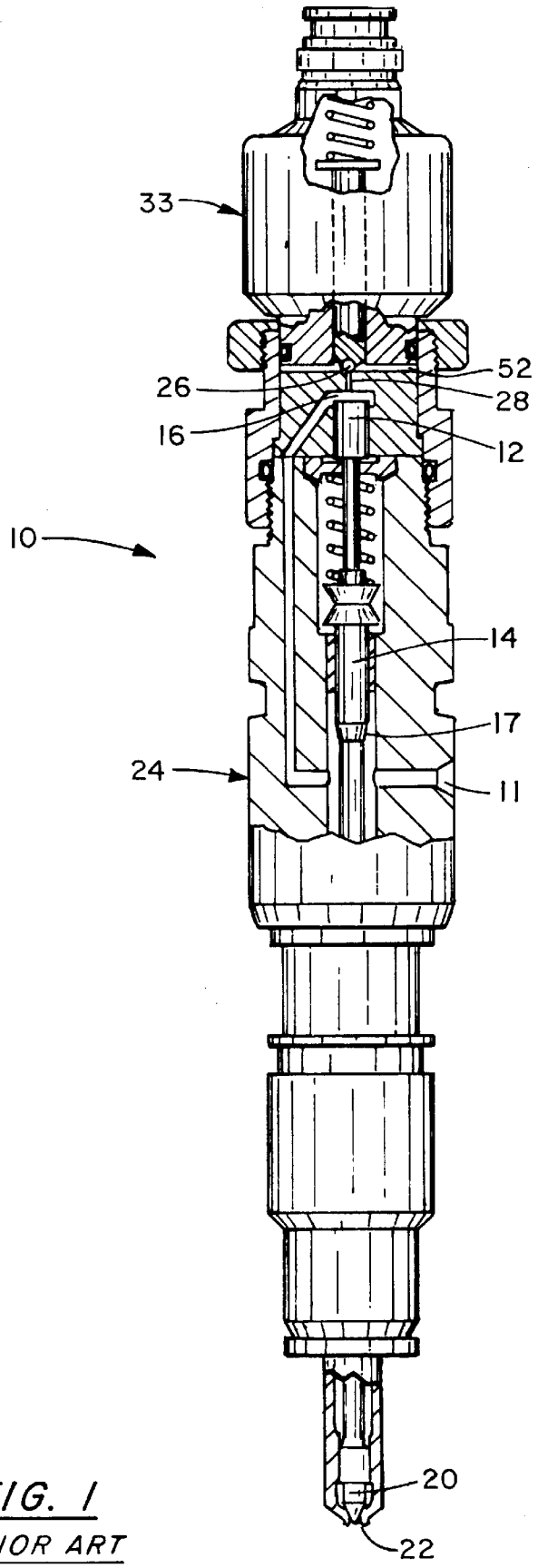
FIG. 1 PRIOR ART
FIG. 1 is a cross-sectional elevation view of a common rail injector of the related art.
Figure 2B:
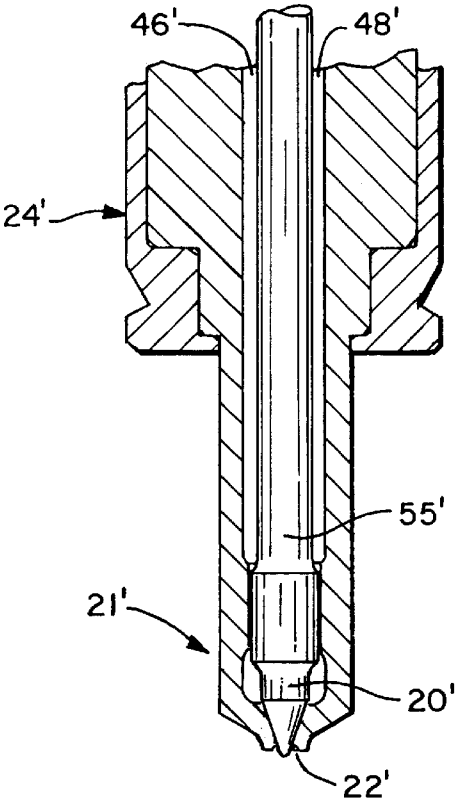
FIG. 2*b* is a cross-sectional elevation view of another portion of the common rail injector partially depicted in FIG. 2*a,* FIG. 2*b* being partially schematic.
Figure 2A:
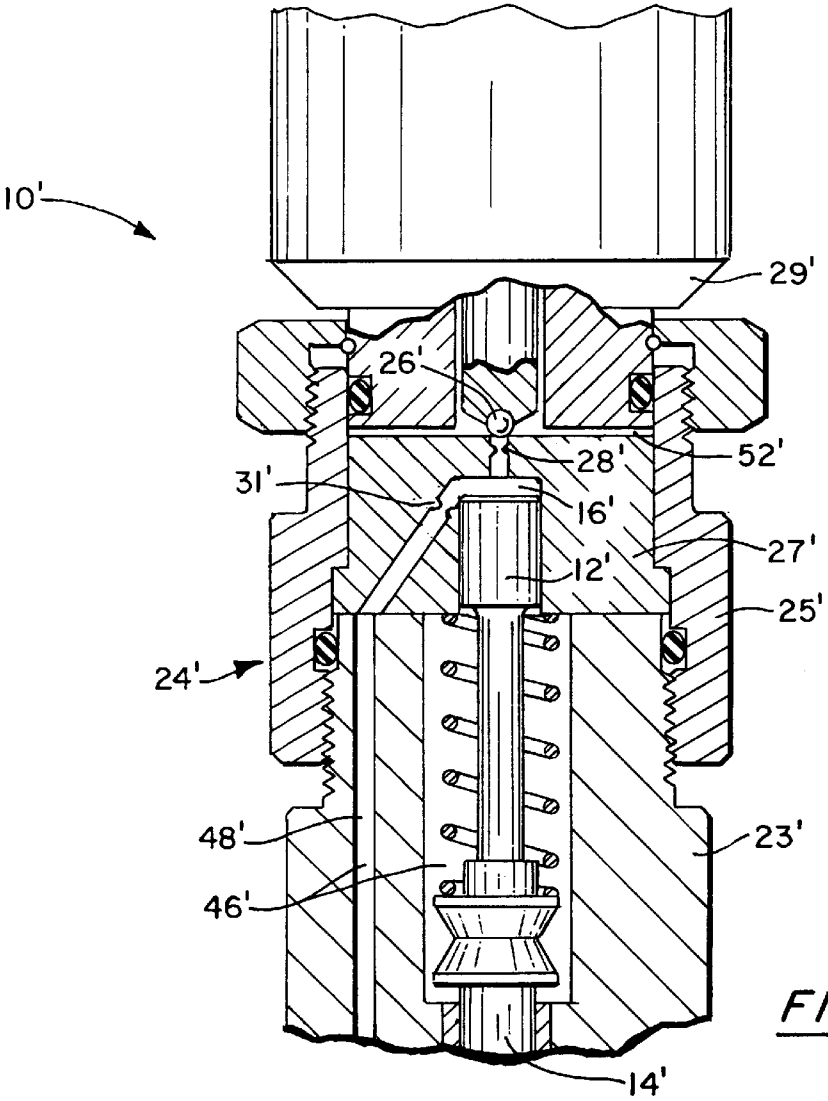
FIG. 2*a* is a cross-sectional elevation view of a portion of a common rail injector for use with the present invention, FIG. 2*a* being partially schematic.

The injector 10' of FIGS. 2*a* and 2*b* includes an injector body 24' which is comprised of a plurality of assembled components 23', 25', 27 and 29'. Injector body 24' can be installed into an internal combustion engine (not shown) with the apertured injector nozzle 21' disposed within the engine cylinder. The internal combustion engine with which the instant invention is used preferably includes an associated high-pressure fuel supply which delivers fuel typically between 2900 to 26100 psi or 200 to 1800 bar, to injector 10'. The engine also includes an associated low-pressure fuel return 15 (see FIG. 3) which removes low-pressure fuel from injector 10'. The high-pressure fuel supply is preferably connected to a high-pressure fuel conduit region 48' of an interior cavity 46', defined within injector body 24'. The interior cavity 46' also includes a control chamber region 16' and a low-pressure fuel region 52' extending therefrom. At least one nozzle aperture 22' extends through the injector body 24' in nozzle region 21' and into the interior cavity 46' to permit fluid communication therebetween.

The injector 10' further comprises a movable needle valve assembly 14' disposed within the interior cavity 46' for movement between fuel-blocking and fuel-injection positions. The needle assembly 14' preferably includes a first end 55' which is capable of sealingly engaging the injector body 24' to block the free flow of fuel through nozzle aperture 22' when the needle valve 14' is in the fuel-blocking position. It will be readily appreciated that needle valve 14' can be shaped in a wide variety of ways to sealingly engage injector body 24' to restrict the flow of fuel through the interior cavity 46' as desired. A second end of the movable needle valve 14' preferably comprises a control, or power, piston 12' which sealingly engages injector body 24' to define the variable-volume control chamber 16' therebetween. As can be seen from FIG. 2*a,* control chamber 16' is preferably connected with high-pressure region 48' via a flow restricting inlet orifice 31'. Similarly, control chamber 16' is connected to low-pressure fuel region 52' via a flow restricting outlet orifice 28'. Since the fluid flow paths immediately downstream of the inlet and outlet orifices rapidly increase in cross-sectional area, fuel flowing therethrough naturally decreases in pressure.

In the injector 10' of FIGS. 2*a* and 2*b,* injection events are controlled by opening and closing control valve 26'. Thus, when control valve 26' is closed, high-pressure fuel remains static in high-pressure fuel region 48', inlet orifice 31', control chamber 16' and outlet orifice 28'. The pressure of these regions is, thus, maintained at a fixed high value. The force of this pressure, in turn, drives needle valve assembly 14' into the fuel-blocking position. Control valve 26' is opened to start the fuel-injection phase of the injection cycle. This permits the high-pressure fuel to pass into low-pressure fuel region 52' which, in turn, reduces the pressure acting on the control piston 12'.

This change in pressure shifts the force balance acting on the needle valve 14' so that needle valve 14' moves upwardly into the fuel-injection position (i.e. any valve position which does not entirely block the flow of fuel through nozzle aperture 22'). Upon closing control valve 26', the high-pressure fuel is, again, prevented from entering low-pressure return 52'. This results in a pressure increase in the control chamber. Consequently, the needle valve assembly 14' will also return to the fuel-blocking position described above.

The above-described changes in the pressure of the fuel flowing through injector 10' induce strains or material deformations within the components of the injector. These deformations are particularly pronounced in the cylinder 27, needle valve 14' and power piston 12. The present invention is directed to utilizing these material deformations to monitor and to control the flow of fuel through injector 10'.

Figure 3B:
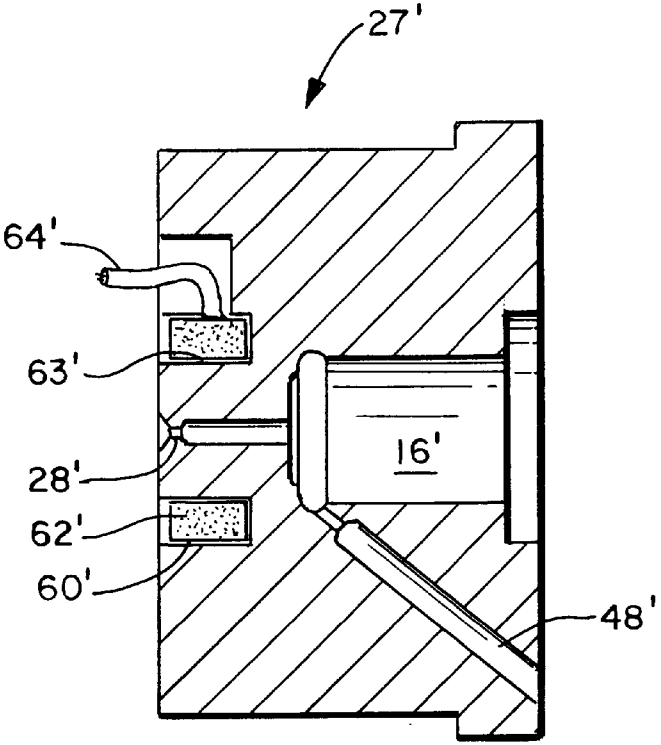
FIGS. 3*a* and 3*b* are a top view and a cross-sectional view taken along line b—b, respectively, of a portion of a common rail injector in accordance with one embodiment of the present invention.
Figure 3A:
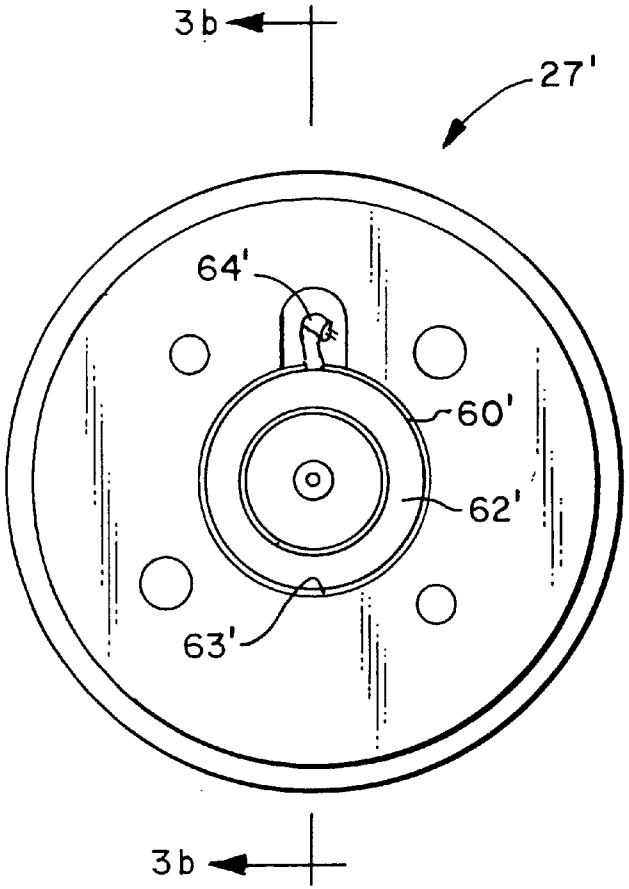

As shown in FIGS. 3*a* and 3*b,* a first preferred embodiment of the instant invention contemplates the placement of a sensor 62' in the form of an annular piezoelectric ring within an annular recess 60' of cylinder 27'. While FIG. 3*a* depicts a top view of cylinder 27', FIG. 3*b* shows a cross-sectional view of cylinder 27' where the cross-section is taken along the line b—b of FIG. 3*a.* As shown in FIGS. 3*a* and 3*b,* sensor 62' includes wire leads 64' extending therefrom so that sensor 62' can be connected to an electronic control unit of a control system. The portion of recess 60' which is not occupied by sensor 62' is filled with an epoxy/plastisol bonding agent 63' and in particular sensor 62' is soldered to the wall which defines the interior boundary of recess 60'. In this manner, sensor 62' is particularly sensitive to the force exerted by fuel pressure and acting within the portion of cylinder 27' which is in between an outlet orifice 28' and recess 60'. Changes in these forces are caused by and, thus, directly related to, fuel pressure changes resulting from fuel flow through outlet orifice 28'. Since such fuel flow necessarily entails concomitant changes in the position of needle valve 14' (see FIGS. 2*a* and 2*b*), the forces detected by sensor 62' can be used to determine the flow of fuel into the engine cylinder. Thus, fuel-flow signals which are generated by sensor 62' and commensurate with material deformations in cylinder 27' can be then be sent to an electronic control unit, e.g., a microprocessor, of a control system associated with the engine. The control system can then use the signals to modify the phasing and duration of injection events by comparing the actual injector performance with the desired injector performance and sending error correction signals to solenoid 30' as necessary.

Figure 4B:
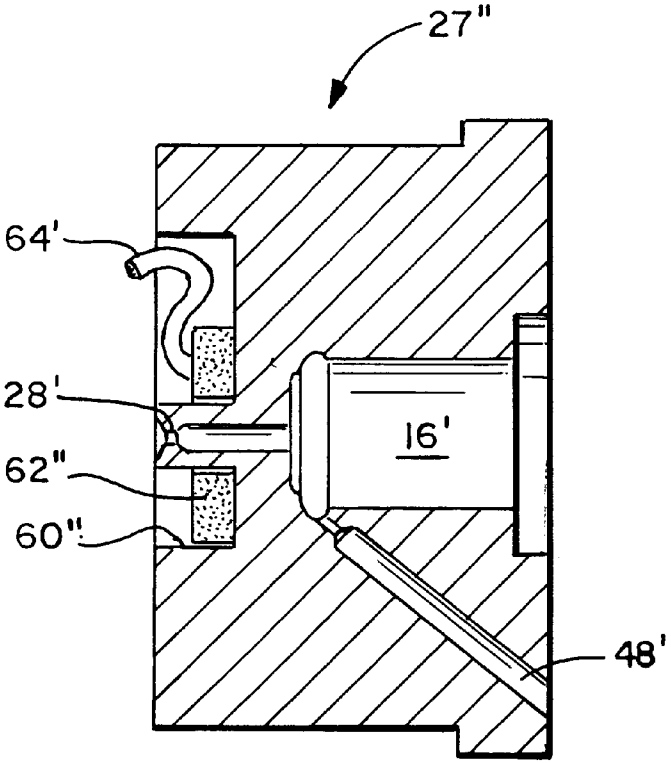
FIGS. 4*a* and 4*b* are a top view and a cross-sectional view taken along line b—b, respectively, of a portion of another common rail injector in accordance with the present invention.
Figure 4A:
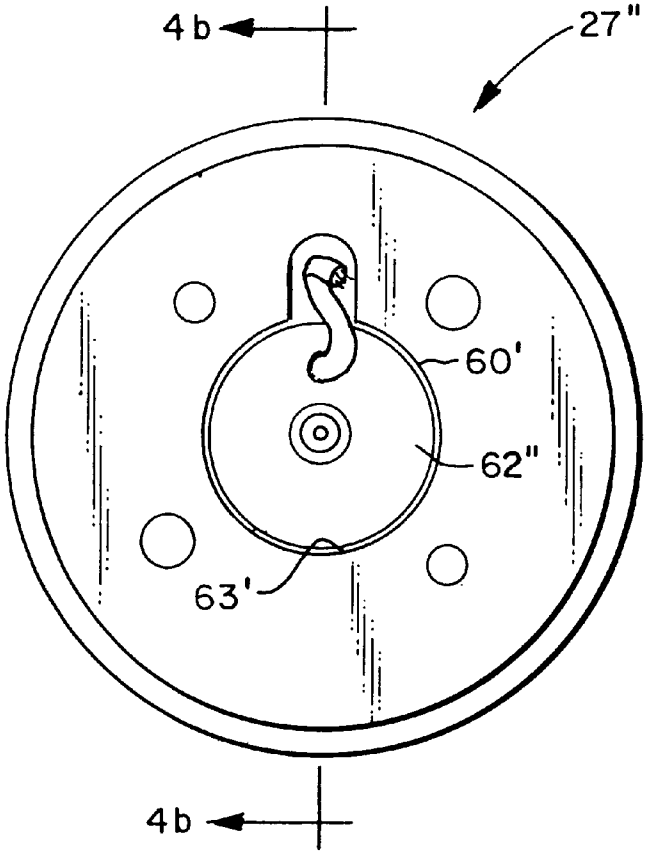

An alternative embodiment of the present invention contemplates the use of another cylinder 27" as depicted in FIGS. 4*a* and 4*b,* FIG. 4*a* depicting a top view of cylinder 27" and FIG. 4*b* depicting a cross-sectional view of cylinder 27" where the section is taken along line b—b of FIG. 4*a.* As shown therein, this embodiment also employs a generally annular sensor 62" disposed within an annular recess 60" of cylinder 27". Annular recess 60" is coaxially disposed about outlet orifice 28' and the portion of recess 60" which is not occupied by sensor 62" is filled with an epoxy/plastisol 63'. Moreover, sensor 62" also includes wire leads 64' to transmit signals from sensor 62" to an electronic control unit of a fuel injection control system. However, in this embodiment sensor 62" is soldered to the bottom of recess 60" such that sensor 62" is particularly sensitive to the forces acting on the portion of cylinder 27" which is disposed between control chamber 16' and recess 60". As with the above-described embodiment, fuel-flow signals generated by sensor 62" are commensurate with material deformations in cylinder 27" and can be sent to an electronic control unit of a control system associated with the engine. The control system can then use the signal to modify the phasing and duration of injection events by comparing the actual injector performance with the desired injector performance and sending error correction signals to solenoid 30' as necessary.

Figure 5C:
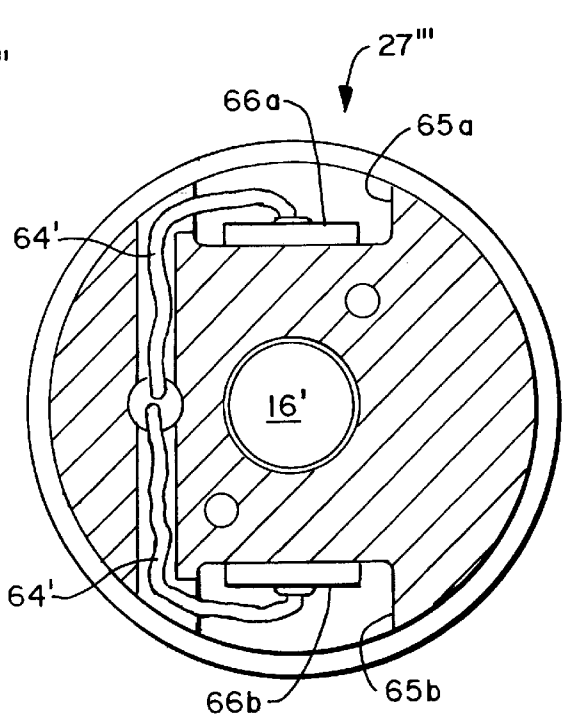
FIGS. 5*a*–5*c* are a top view, a cross-sectional elevation view taken along line b—b and a cross-sectional top view taken along line c—c, respectively, of yet another portion of a common rail injector in accordance with the present invention.
Figure 5B:
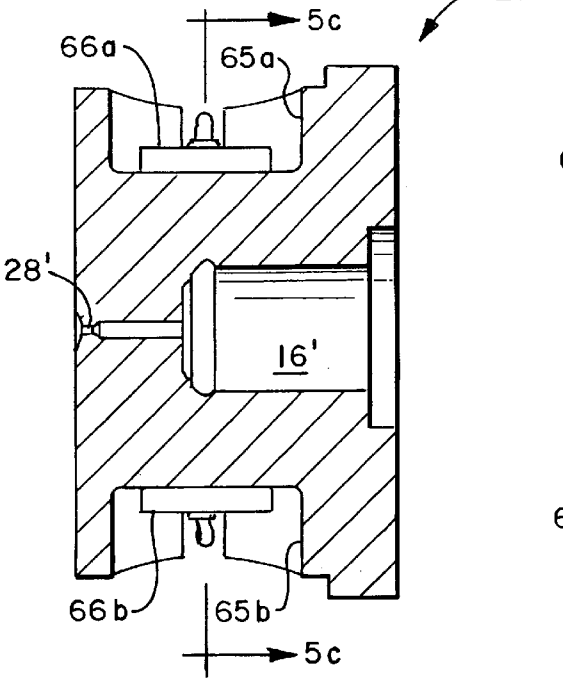
Figure 5A:
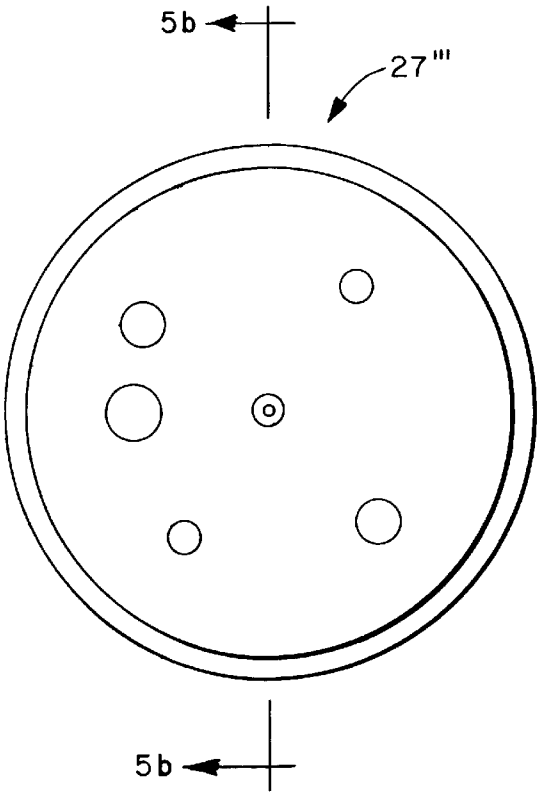

Still another alternative embodiment of the present invention is depicted in FIGS. 5*a*–5*c*. FIG. 5*a* is a top view of cylinder 27'".

FIG. 5*b* is a cross-sectional view of cylinder 27'" taken line b—b of FIG. 5*a*. FIG. 5*c* is a cross-sectional view of cylinder 27'" taken along line c—c of FIG. 5*b*. As shown in FIGS. 5*a*–5*c,* cylinder 27'" defines control chamber 60', outlet orifice 28' and opposed recesses 65*a* and 65*b* which are generally tablet-shaped recesses coaxially disposed at the line of intersection of the planes defined by sections b—b and c—c. Generally disk-shaped piezoelectric sensors 66*a* and 66*b* are disposed within recesses 65*a* and 65*b* such that sensors 66*a* and 66*b* face one another. Sensors 66*a* and 66*b* are soldered to the circular bottom faces of recesses 65*a* and 65*b* so that these sensors are particularly sensitive to forces acting within the portion of cylinder 27'" disposed between control region 60' and outlet orifice 28' and recesses 65*a* and 65*b*. Also, wire leads 64' which extend from sensors 66*a* and 66*b* can be routed through an additional channel in cylinder 27'" and, ultimately, connected to an electronic control unit of an associated injector control system. Naturally, the signals produced by sensors 66*a* and 66*b* can be sent to the electronic control unit via leads 64' and utilized in the same general manner described above with respect to the earlier embodiments of the instant invention.

Figure 6:
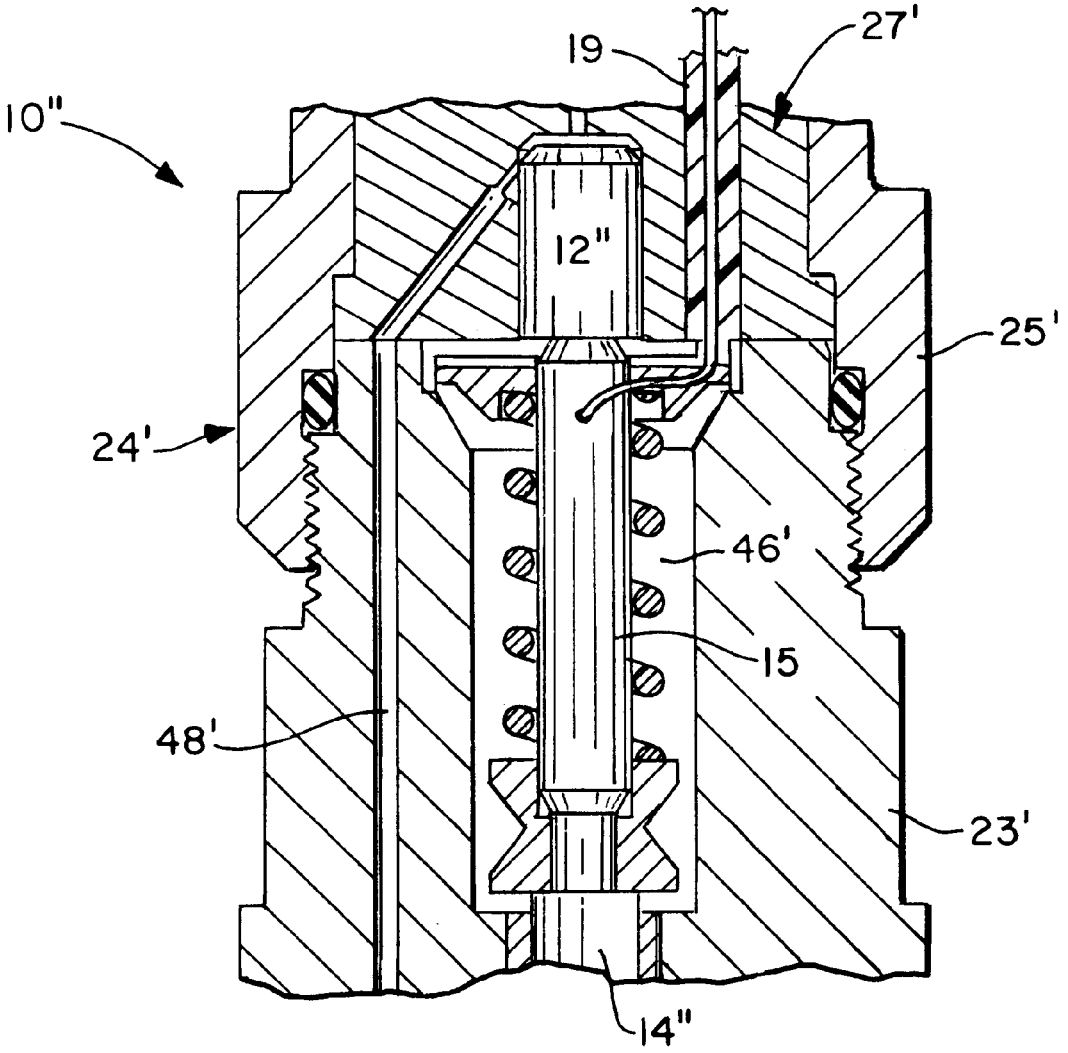
FIG. 6 is a partially cross-sectional and partially schematic elevation view of a portion of a common rail injector incorporating an alternative embodiment of the present invention.

Yet another alternative embodiment of the instant invention is illustrated in FIG. 6. As shown therein, the present invention also entails embodiments wherein the sensing means is incorporated into needle valve 12". In particular, needle 12" can include a load cell 15 which is axially aligned with the remainder of a needle 12" for movement therewith during use in the normal manner. Load cell 15 preferably comprises either a piezoelectric component or a metal component (e.g., steel) with a strain-gauge bonded thereto. In either case, material defamations occurring within load cell 15 are detected by the sensor and signals commensurate therewith are sent to an electronic control unit via leads 19 and utilized in the same manner described above with respect to earlier embodiments of the present invention. Since the defamations within load cell 15 are the product of the same pressure changes discussed above, the material deformations within load cell 15 reflect the injection events in the same general manner as material deformations occurring within cylinder 27'.

Figure 7A:
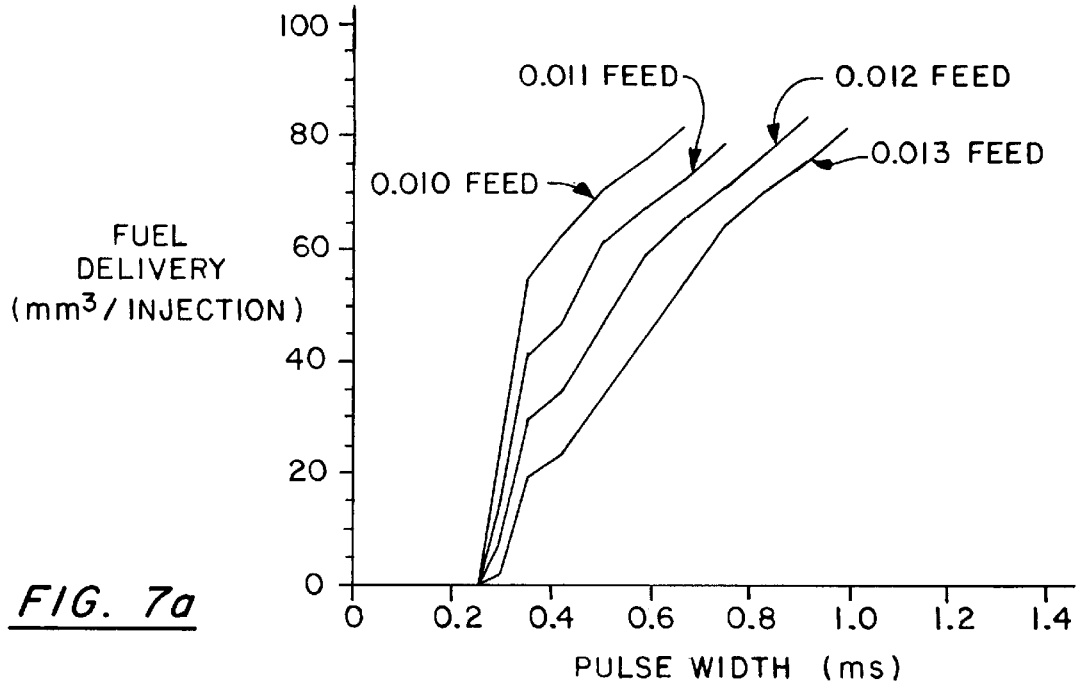
FIGS. 7*a* and 7*b* are charts illustrating the relationship between fuel delivery quantity and pulse width and between fuel delivery quantity and injection duration in various fuel injectors.
Figure 7B:
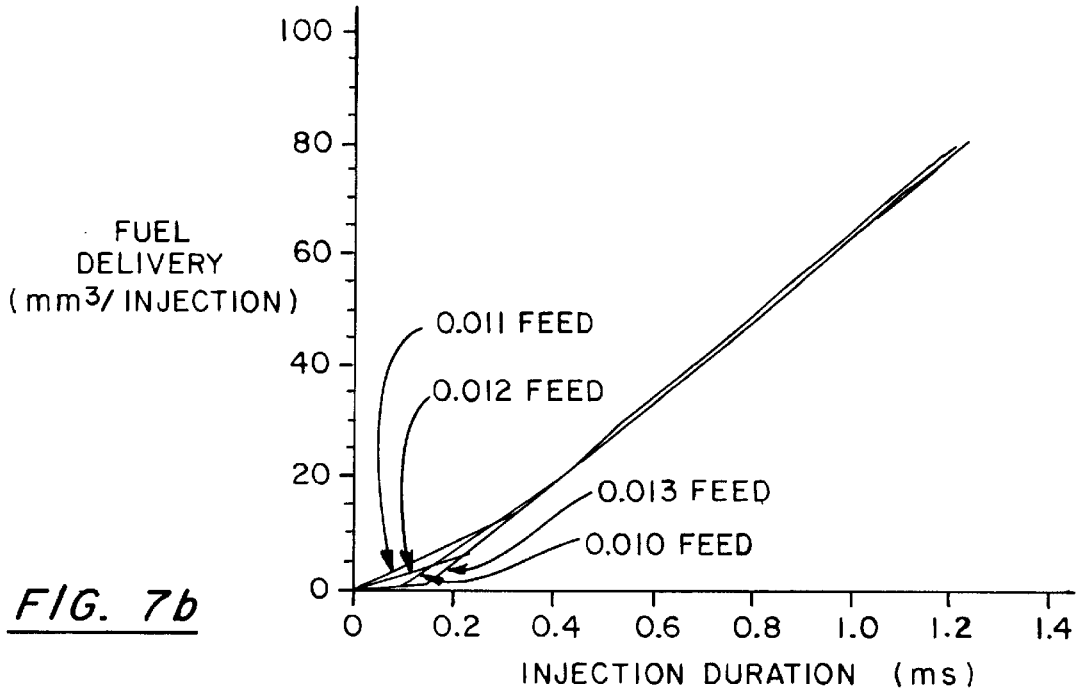

The superior fuel flow control of the present invention is a direct result of the invention's utilization of fuel-flow sensors to detect injection duration rather than electrical sensors to detect the pulse width of the electrical signal delivered to the solenoid. In FIG. 7*a,* the quantity of fuel flowing into an engine cylinder is shown as a function of solenoid signal pulse width for fuel feed holes of various diameters. In FIG. 7*b,* the quantity of fuel flowing into an engine cylinder is shown as a function of actual injection duration for fuel feed holes of various diameters. As shown in FIG. 7*a,* fuel delivery into an engine cylinder is not linearly related to the width of an electrical pulse sent to an injector solenoid for any of the feed hole diameters shown therein. This non-linearity stems from several factors including the need to sufficiently energize the solenoid before fuel injection can begin and the fact that movement of the solenoid only causes indirect movement of the nozzle needle. Thus, precise control (e.g., modification) of fuel flow is difficult when such control is based on solenoid pulse width monitoring.

By contrast, FIG. 7*b* illustrates that fuel flow into an engine cylinder is substantially linearly related to actual injection duration resulting from nozzle needle valve movement even for various feed hole diameters. Accordingly, fuel-flow control is greatly simplified by monitoring injection duration rather than solenoid pulse width.

Figure 8A:
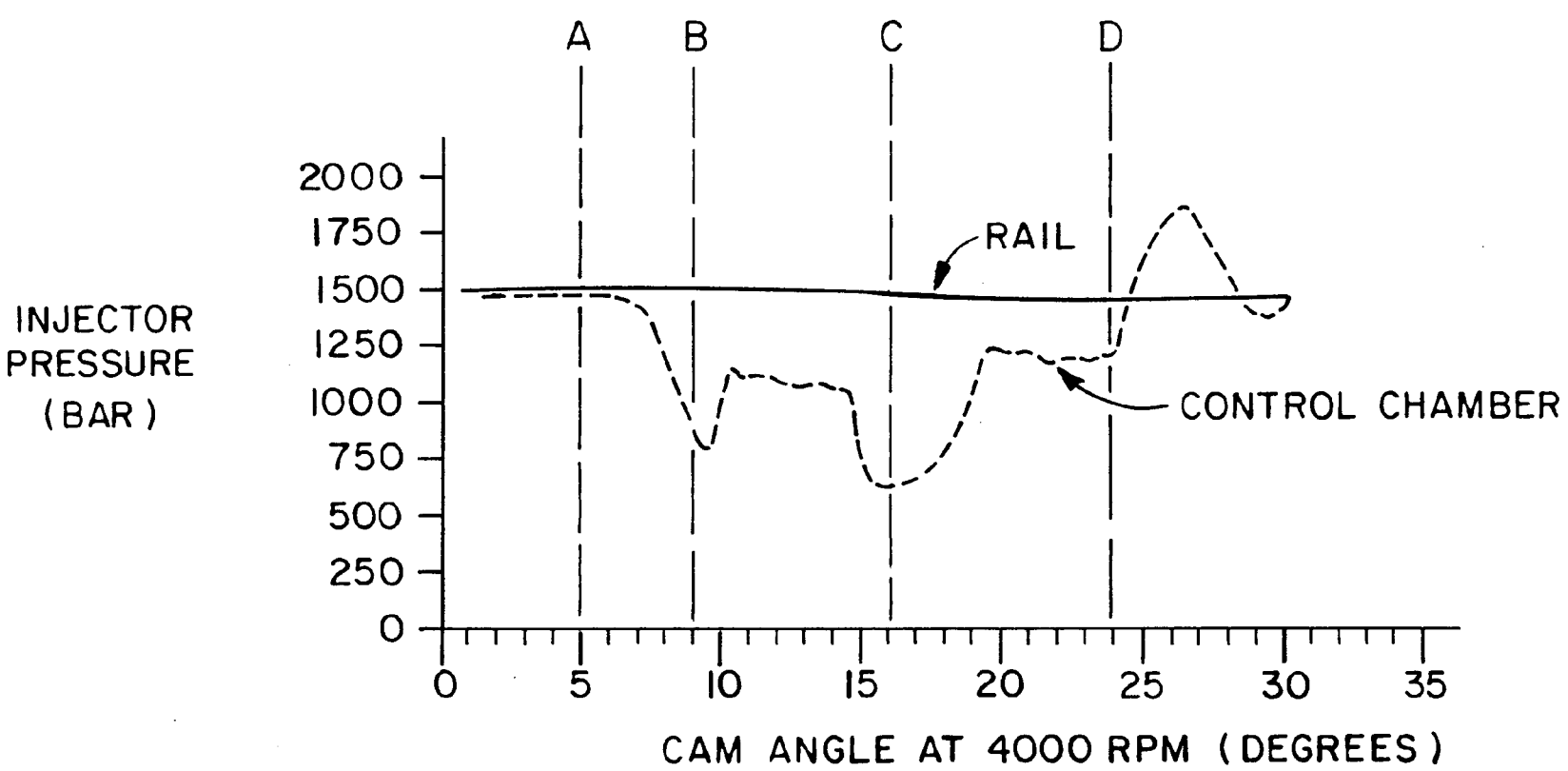
FIG. 8 is a chart depicting flow areas, valve lift and pressure occurring within an injector in accordance with the present invention over the course of one injection cycle.
Figure 8B:
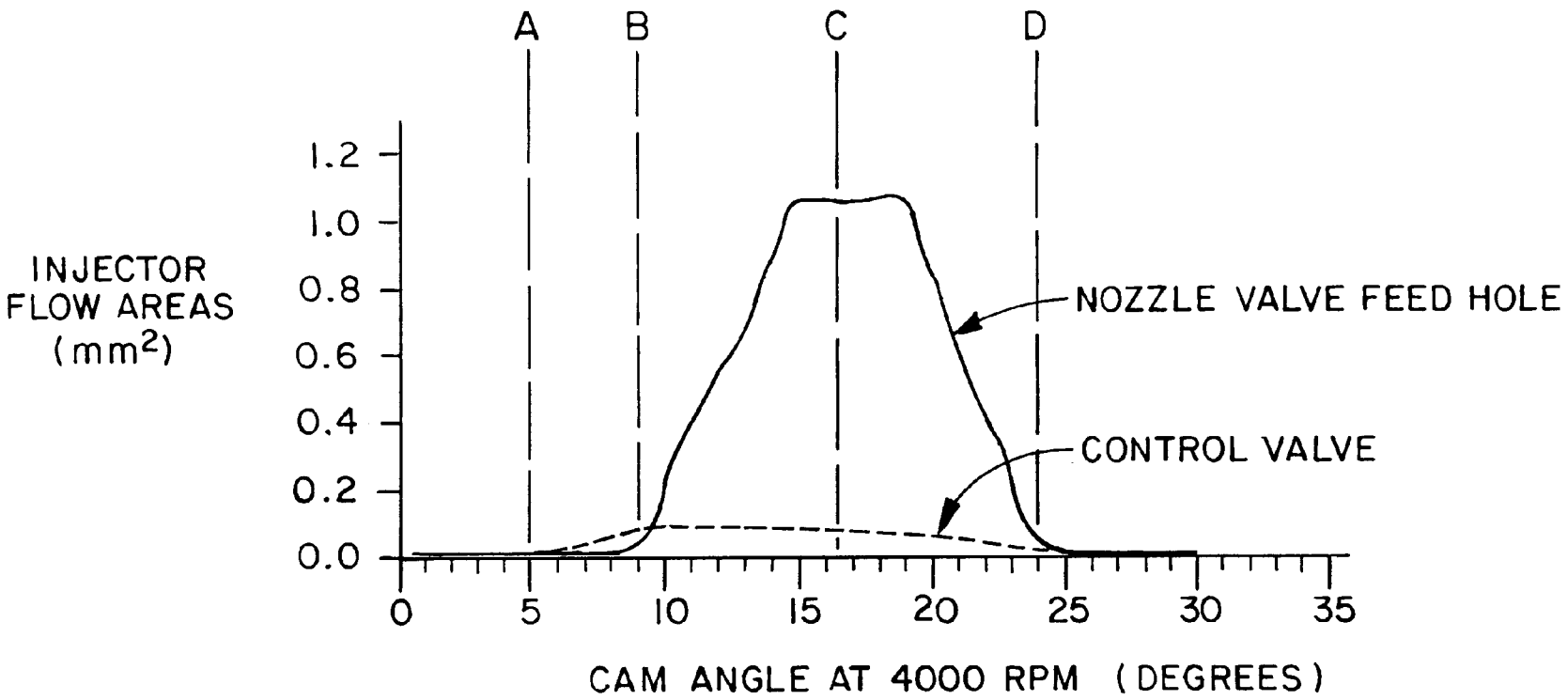

The principles behind the present invention can be alternatively illustrated as shown in FIG. 8. As shown therein, injector pressure, injector flow areas and injector valve lift are all depicted as a function of the cam angle for a typical diesel engine operated at about 4,000 rpm. As shown, the rail pressure remains relatively constant over the course of the first 30° of cam angle rotation. By contrast, the pressure within the control chamber varies greatly over the course of the first 30 ° of cam rotation. As shown therein, line A represents the point at which power is delivered to the solenoid, line B demarcates the beginning of the injection phase of the injection cycle (BOI), line C demarcates the time at which power is removed from the solenoid and line D demarcates the point which ends the injection phase of the injection cycle (EOI).

As shown in the bottom of FIG. 8, the nozzle valve experiences marked lift during the period between line B and line D. Naturally, this corresponds with the period of marked increase in cross-sectional area of the nozzle valve feed hole and fuel flow through this hole. By contrast, the control valve generally experiences lift in the period between lines A and C, this corresponding with the period of increase in the cross-sectional area of the control valve aperture and the flow of fuel into low pressure fuel region 52'.

Injector flow areas are depicted in the center of FIG. 8. As shown therein, the area for fuel flow through the nozzle valve feed increases dramatically between lines B and D which closely corresponds with the period in which the pressure within the control chamber is relieved. Also as shown in the center of FIG. 8, the area for fuel flow through the control valve generally increases only during the time period between lines A and C. Thus, the period of marked increase in the cross-sectional area of the nozzle valve feed hole is longer than and delayed from the period of increase in the cross-sectional area of the control valve aperture. This discrepancy results in an actual injection duration which is not linearly related to fuel flow through the control valve aperture.

As can be seen from review of the FIGS. 7*a,* 7*b* and 8 collectively, the pressure within the control chamber and acting on the injector cylinder is directly related to the flow of fuel through the nozzle valve feed hole and into the engine cylinder. Additionally, the flow of fuel through the nozzle valve feed hole is linearly related to fuel delivery into the engine cylinder. Accordingly, the instant invention is capable of precisely controlling the quantity of fuel delivered into the engine cylinder by monitoring the deformations in the injector cylinder or needle valve/power piston column and using such information to control the flow of fuel through the injector.

Many variations of the present invention are possible. For example, the sensor locations of FIGS. 3–6 can be altered to some extent without severe degradation in sensing capability. However, it should be noted that the locations indicated are the preferred locations because the stresses generated within the injector cylinder occurring during each injection cycle are maximized at these locations. Additionally, one or more of the sensors of FIGS. 3–6 can be utilized in combination to produce multiple sensor signals. Naturally, and as noted above, the principles of the present invention as discussed herein are readily adaptable to a wide variety of well-known and commonly used types of fuel injectors. Similarly, the principles of the present invention discussed herein are readily adaptable to a variety of known and commonly used types of fuel injection control systems. While the piezoelectric sensors discussed herein are commercially available from Morgan Matroc Inc., a variety of other piezoelectric sensors could be substituted therefor. The preferred mounting method is to electrically ground the sensor using a soldering or brazing procedure and then backfill the sensor with epoxy to maximize transition of component strain. The preferred bonding material is epoxy which is commercially available under the name Eccobond 286 from Emerson & Cuming Inc. Finally, the preferred material for forming the cylinder is tool steel due to the linear nature of the strains produced therein under the force of pressurized fuel flowing therethrough.

While the present invention has been described in connection with what is presently considered to be the most practical and preferred embodiments, it is to be understood that the present invention is not limited to the disclosed embodiments. Rather, it is intended to cover all of the various modifications and equivalent arrangements included within the spirit and scope of the appended claims.

I claim:

In the claims:

1. A fuel injector of the type used to inject fuel into a cylinder of an internal combustion engine when installed therein, the engine having a high-pressure fuel supply which delivers fuel to said injector and a low-pressure fuel return which removes fuel from said injector, said injector comprising:

an injector body which defines an interior cavity, said interior cavity including a variable-volume control region, a high-pressure fuel region fluidly connected with the high-pressure fuel supply, an apertured nozzle region fluidly connected with the engine cylinder when said injector is installed in the engine, and a low-pressure fuel region fluidly connected with the low-pressure fuel return;

a needle valve assembly at least partially disposed within said injector for movement between first and second positions, said needle having an injection portion which blocks fuel flow through said nozzle region when said needle is in said first position, said injection portion of said needle permitting fuel flow through said nozzle region when said needle is in said second position;

valve means for selectively permitting fluid flow between said control region and said low-pressure fuel region to thereby vary the volume of said control region and urge said needle assembly between said first and second positions; and sensor means for sensing injector body deformations caused by forces acting within said injector body in the vicinity of said variable volume control region when said needle assembly moves between said first position and said second position, said sensor means being disposed in the vicinity of said variable volume control region.

2. The injector of claim 1 wherein said injector body includes a cylinder which defines said control region of said interior cavity, said cylinder further defining an outlet orifice which fluidly connects said low-pressure fuel return with said control region, wherein said sensor means comprises a piezoelectric ring which is disposed about said outlet orifice.

3. The injector of claim 2 wherein said control region and said outlet orifice define an axis and wherein said piezoelectric ring is coaxially disposed about said axis.

4. The injector of claim 2, wherein said cylinder further defines generally annular recess around said outlet orifice, and wherein said piezoelectric ring is at least partially disposed within said annular recess.

5. The injector of claim 4, wherein said annular recess is bounded on a radially inside boundary thereof by a generally cylindrical wall of said cylinder and wherein said piezoelectric ring is only fixedly attached to said cylinder at said cylindrical wall.

6. The injector of claim 4, wherein said annular recess is bounded at one end thereof by a generally hollow-circle-shaped wall of said cylinder and wherein said piezoelectric ring is only fixedly attached to said cylinder at said hollow-circle-shaped wall.

7. The injector of claim 2, wherein said outlet orifice is a flow restricting outlet orifice, said cylinder defines an annular recess which is axially disposed about said outlet orifice, and said piezoelectric ring is at least partially disposed within said recess.

8. The injector of claim 1 wherein said injector body includes a cylinder which defines said control region of said interior cavity, said control region defining a first axis, said cylinder further defining at least one recess with a generally planar face extending generally parallel to said first axis, and wherein said sensor means comprises a piezoelectric sensor which is disposed within said recess.

9. The injector of claim 8, wherein said planar face of said recess is generally circular and wherein said piezoelectric sensor is only fixedly attached to said planar face.

10. The injector of claim 8, wherein said cylinder defines at least one additional recess with a generally planar face, wherein said generally planar faces are parallel to one another and wherein said sensor means comprises one piezoelectric sensor disposed within each of said recesses.

11. The injector of claim 10, wherein said control region is generally cylindrical and has a diameter, said piezoelectric ring has inner and outer diameters, and said diameter of said control region is less than said ring outer diameter and greater than said ring inner diameter.

12. A method of controlling a fuel injector of the type used to inject fuel into a cylinder of an internal combustion engine when the injector is installed therein, the engine having a high-pressure fuel supply which delivers fuel to the injector, a low-pressure return which removes fuel from the injector and an electronic control unit for sending, receiving and processing control signals related to injector operation, the injector having a variable-volume control chamber in selective fluid communication with the high-pressure fuel supply and the low-pressure fuel return, the injector also having a needle valve assembly disposed within the injector for movement between an injection-blocking position wherein fuel is not permitted to flow from the high-pressure fuel supply into the engine cylinder, and an injection-permitting position wherein fuel is permitted to flow from the high-pressure fuel supply into the engine cylinder, the needle movement being dependent on the fuel flow through the control chamber, the injector also having a fuel-flow valve for selectively establishing fluid communication between the control chamber and at least one of the high-pressure fuel supply and the low-pressure fuel return, said method comprising the steps of:

sending an injector control signal to the injector from the electronic control unit to operate the fuel-flow valve such that fluid communication between the control chamber and at least one of the high-pressure fuel supply and the low-pressure fuel return is selectively established whereby material deformations are induced in at least one portion of the injector;

sensing the material deformations induced in the one portion of the injector;

generating a fuel flow signal commensurate with the material deformations induced in the one portion of the injector;

transmitting the fuel-flow signal to the electronic control unit;

receiving the fuel-flow signal at the electronic control unit;

comparing the injector control signal with the fuel-flow signal; and sending an error correction signal to the injector if the injector control signal differs from the fuel-flow signal by more than a predetermined amount.

13. The method of claim 12 wherein said step of sensing comprises sensing material deformations caused by forces acting within the injector body in the vicinity of the control chamber to produce a fuel flow signal commensurate with the fuel flow through the control chamber.

14. The method of claim 12 wherein said step of sensing comprises sensing material deformations caused by forces acting within the injector body in the vicinity of the control chamber to produce a fuel flow signal commensurate with the fuel flow into the low-pressure return.

15. The method of claim 12 wherein said step of sensing comprises sensing material deformations induced in the needle valve assembly to produce a fuel flow signal.

16. A fuel injector of the type used to inject fuel into a cylinder of an internal combustion engine when installed therein, the engine having a high-pressure fuel supply which delivers fuel to said injector and a low-pressure fuel return which removes fuel from said injector, said injector comprising:

an injector body which defines an interior cavity, said interior cavity including a variable-volume control region, a high-pressure fuel region fluidly connected with the high-pressure fuel supply, an apertured nozzle region fluidly connected between the high-pressure fuel supply and the engine cylinder when said injector is installed in the engine, and a low-pressure fuel region fluidly connected between said control region and the low-pressure fuel return;

a needle at least partially disposed within said injector for movement between first and second positions, said needle having an injection portion which is capable of blocking fuel flow into the engine cylinder when said needle is in said first position;

a valve for selectively interrupting fluid communication between said control region and said low-pressure region, said valve being disposed for movement between an initial position, wherein said control region is not in fluid communication with said low-pressure region whereby said needle is urged toward said first position, and an injection position, wherein said control region is in fluid communication with said low-pressure region whereby said needle is urged toward said second position; and a sensor for sensing material deformations caused by forces acting within said injector while said needle assembly is urged toward said first and second positions.

17. The injector of claim 16, wherein said injector body includes a cylinder which defines said control region of said interior cavity, said cylinder further defining an outlet orifice which fluidly connects said low-pressure fuel region with said control region, wherein said sensor comprises a piezoelectric ring which is disposed about said outlet orifice.

18. The injector of claim 16, wherein said cylinder further defines generally annular recess around said outlet orifice, and wherein said piezoelectric ring is at least partially disposed within said annular recess.

19. The injector of claim 18, wherein said annular recess is bounded on a radially inside boundary thereof by a generally cylindrical wall of said cylinder and wherein piezoelectric ring is only fixedly attached to said cylinder at said cylindrical wall.

20. The injector of claim 18, wherein said annular recess is bounded at one end thereof by a generally hollow-circle-shaped wall of said cylinder and wherein said piezoelectric ring is only fixedly attached to said cylinder at said hollow-circle-shaped wall.

21. The injector of claim 17, wherein said outlet orifice is a flow restricting outlet orifice, said cylinder defines an annular recess which is disposed about said outlet orifice, and said piezoelectric ring is at least partially disposed within said recess.

22. The injector of claim 16 wherein said injector body includes a cylinder which defines said control region of said interior cavity, said control region defining a first axis, said cylinder further defining at least one recess with a generally planar face extending generally parallel to said first axis, and wherein said sensor comprises a piezoelectric sensor which is disposed within said recess.

23. The injector of claim 22, wherein said planar face of said recess is generally circular and wherein said piezoelectric sensor is only fixedly attached to said planar face.

24. The injector of claim 23, wherein said cylinder defines at least one additional recess with a generally planar face, wherein said generally planar faces are parallel to one another and wherein said sensor comprises one piezoelectric sensor disposed within each of said recesses.

25. The injector of claim 16, wherein said sensor comprises a load cell which also forms a portion of said needle.

26. The injector of claim 25, wherein sensor load cell comprises a piezoelectric crystal.

27. The injector of claim 25, wherein sensor load cell comprises a rigid member having a strain-gauge affixed thereto.

* * * * *